United States Patent [19]

Buckley

[11] Patent Number: 4,514,072

[45] Date of Patent: Apr. 30, 1985

[54] X-RAY FILM HOLDER APPARATUS

[76] Inventor: Arthur B. Buckley, 1506 Maple Ave., Northbrook, Ill. 60062

[21] Appl. No.: 543,043

[22] Filed: Oct. 18, 1983

[51] Int. Cl.[3] ..... B08B 3/08; G03D 13/08

[52] U.S. Cl. ..... 354/337; 134/137; 211/41; 269/47; 294/161; 354/344

[58] Field of Search ..... 134/135, 137–139, 134/64 P, 85; 99/410–415; D16/33–37; 354/340, 344–347, 297, 331, 337; 378/167; 211/41, 113; 269/40, 43, 47; 294/87 R, 159, 161

[56] References Cited

U.S. PATENT DOCUMENTS

| | | | |
|---|---|---|---|
| 1,484,291 | 2/1924 | Blakeslee | 211/41 |
| 1,629,285 | 5/1927 | Mabee | 354/344 |
| 1,782,068 | 11/1930 | Hazell | 354/344 |
| 2,121,225 | 6/1938 | Ghrist | 354/344 |
| 3,433,363 | 3/1969 | Clearman et al. | 211/41 |
| 3,717,334 | 2/1973 | Miller et al. | 269/40 X |

*Primary Examiner*—Harvey C. Hornsby
*Assistant Examiner*—Stuart J. Maltzman
*Attorney, Agent, or Firm*—Dick and Harris

[57] ABSTRACT

An improved X-Ray film holder apparatus for restrainably maintaining a plurality of X-Ray films in position within conventional developing and chemical processing tank insert trays. A holder fixture with upper and lower ends embodies a plurality of film holder members having an alternating series of substantially trapezoidal shaped flanges and recesses to describe a plurality of notched regions into which opposite edges of X-Ray films may be restrainably inserted and positioned. Pairs of aligned film holder members serve to restrain each one of the plurality of X-Ray films and handle means are operably positioned along the fixture for cooperation with the chemical processing insert tray. The flanges themselves and/or the upper and lower ends of the fixtures are shaped to preclude the inadvertent contact of supporting articles with any portion of the bowed films restrained in place within the film holder apparatus. The overall film holder is shaped to be telescopically received by standardized chemical tank insert trays while at the same time maximizing the number of independently segregated X-Ray films positionable within the holder apparatus.

12 Claims, 4 Drawing Figures

X-RAY FILM HOLDER APPARATUS

BACKGROUND OF THE INVENTION

The present invention relates in general to X-Ray developing equipment for medical and dental X-Rays, and particularly to an improved X-Ray film holder apparatus for restrainably maintaining a plurality of X-Ray films in position within conventionally shaped and dimensioned developing tank equipment and particularly within the insert trays embodied by such developing equipment.

While medical and dental practices and/or laboratories have relied upon conventional developing tanks and trays for years in association with their diagnostic X-Ray services, few, if any, changes have occurred through the years relative to the actual holding apparata or fixtures within which these X-Ray films are maintained for submersion into the chemicals contained within such developing and processing tanks.

For the most part, the prior art film holding apparata have been of two main types. The first type embodies a substantially costly series of apertured bars and continuous side bars which are collectively pivoted about a separate housing for insertion of the X-Ray film or removal of such film, and then pivoted back and latched to maintain the X-Ray film in position. A second "alligator type" holder apparatus has been utilized in which clips, with sharp points under spring bias, are utilized to clip the X-Ray films into position along one holding point. Both types of prior art devices are then submerged into such conventional chemical developing tank insert trays.

The particular constructions of the prior art devices have often precluded maximizing the number of "holdable" X-Ray films which may be maintained in position within the given space restrictions of the conventional developing tank insert trays. The pivotable type of prior art has required substantial expense and excessive operations in securely placing films in elements with many moving parts of pivotal movement and latching. Additionally, maintenance of film at a single position in alligator clips during the developing process can cause inadvertent release of the films requiring the "dredging up" of the "lost" X-Ray film from the bottom of the chemical tray. Additionally, devices such as the alligator clip device have often defaced and/or punctured such X-Ray films or, in the case of the pivoting aperture bar structure, have brought substantial portions of each X-Ray film into contact with the metal forming the apertures so as to restrain the ability of solution to circulate at such points of contact and/or otherwise mar or affect the film. Indeed, reliance upon the alligator type clips have often precluded the ability to "swish" the holder within the tray for improved circulation of the developing or fixing chemicals, because of the unrestrainable manner in which the X-Ray films were maintained in position by such alligator clip type apparata.

It is thus an object of the present invention to provide an improved X-Ray film holder apparatus which maximizes the number of segregated film positions available for holding and maintaining, in a securly restrainable fashion, the optimal number of X-Ray films possible within the size and dimension limitations of standard sized developing tank trays.

It is additionally an object of the present invention to provide such an X-Ray film holder which permits easy insertion of X-Ray films into and out of the film holder while minimizing the amount of structural contact between the film holder itself and the X-Ray film being developed—with minimized defacement and puncturing of the X-Ray films.

The present invention also has as an object the improved and facilitated positioning of such X-Ray films within an X-Ray film holder which permits "swishing" circulation through reciprocation of the overall device within the chemical tank tray, while minimizing the ability for such device to inadvertently release one or more of the X-Ray films maintained in position therewithin—while at the same time being of such a construction as to be inexpensive to manufacture with virtually no moving parts.

These and other objects of the invention will become apparent in light of the present specification and drawings.

SUMMARY OF THE INVENTION

The present invention relates to an improved X-Ray film holder apparatus for restrainably maintaining a plurality of individual bowed X-Ray films in position within conventionally shaped developing tank insert trays. The apparatus comprises a substantially flat holder fixture having upper and lower end members as well as a plurality of film holder members running transverse to the upper and lower ends so as to be operably disposed between the top and bottom end members in a direction substantially parallel to the longitudinal axis of the holder fixture.

Two or more of the film holder members have an alternating series of substantially trapezoid-shaped flange portions and trapezoid-shaped recess portions to describe a plurality of notched regions into which the opposite peripheral edges of X-Ray film, which is preliminarily bowed, may be inserted for restrainable positioning. Each one of the two or more film holder members having such alternating flange and recess portions are in substantial alignment so as to effectively align each of the flange and recess portions, respectively, along both of the two aligned film holder members to in turn align each of the notched regions with each of the opposite peripheral edges being maintained in position along at least two notched regions for purposes of improved stability.

Fixture position maintenance means are operably attached along either or both of the upper and lower ends for facilitating the loading, maintenance and unloading of the film holder in and from the conventional developing tank insert tray. Additionally, means are included for precluding the undesired and inadvertent contact of articles with the bowed surfaces of the X-Ray films restrainably positioned within the film holder. Furthermore, the film holder fixture is of such a thickness and height, even with the bowed films restrainably positioned therewithin, so as to closely and telescopically be received by one or more of the developing tanks insert trays.

In the preferred embodiment of the invention the notched regions include abrasion means at the positions where the notched regions contact the opposite peripheral edges of the bowed X-Ray film, to further preclude the inadvertent and undesirable migration of the film during the chemical developing or fixing processes. Preferably this abrasion means comprises a jagged or roughened surface portion within the notched region where the edges of the actual X-Ray film contact same for restrained maintenance therewithin.

Preferably, the holder fixture includes two pairs of aligned film holder members to accommodate two separate columns of restrainably positioned X-Ray films therewithin. In such an embodiment, the film holder fixture includes twelve rows of notched regions described by the film holder members, with each pair of adjacent notched region rows capable of holding the opposite peripheral edges of one of the bowed X-Ray films so as to be capable of collectively restraining six rows of bowed X-Ray film along each of the columns for a total of twelve films maintained on one side of the fixture. Moreover, the preferred embodiment contemplates fabrication of the flange and recess portions along both sides of each of the film holder members to describe, collectively, a total of twenty-four rows of notched regions and four separate columns of aligned film holder pairs. This particular preferred embodiment, with twenty-four double sided rows and four columns is capable of maintaining twenty-four X-Ray films respectively along both sides of the film holder apparatus, for maintenance within a standard sized conventional developing tank insert tray.

In this embodiment, the fixture position maintenance means comprises a handle member which is operably positioned along the upper end of the holder fixture for cooperation with the upright edge of the developing tank insert tray to maintain the overall position of the film holder apparatus appropriately during the X-Ray film developing or fixing processes. Moreover, while the X-Ray film holder apparatus is positioned within the developing tank insert tray, it may be easily reciprocated within the developing tank tray to effectively circulate solutions contained within the tray over all the surfaces of the positioned films. With the upper and lower peripheral edges of the films respectively facing, in a substantial manner, the upper and lower ends of the holder fixture means, the turbulence created by the reciprocation or "swishing" action is reduced to preclude splashing, to minimize fluid resistence within the tray and to preclude the inadvertent release of any one of the X-Ray films from within the film holder apparatus positioned within the tray which may be caused by substantial fluid resistence and/or turbulence.

The means for precluding article contact comprises, in the present invention, structuring the height of one or more of the trapezoid-shaped flanges to extend beyond the outermost bowed positions of the X-Ray films to act as a guard against contact of such films by articles upon which the holder apparatus may be flatly placed. In another embodiment of the invention, the means for precluding article contact comprises the height of the upper and lower ends being extended beyond the outer most bowed positions of the X-Ray films to equivalently preclude the inadvertent and undesirable contact of the bowed film portions by articles upon which the holder apparatus has been flatly placed such as, for example, during the process in which X-Ray film is inserted into or removed from the notched regions.

The film holder apparatus preferably includes indicia placement means for maintaining identifying indicia relating to the particular X-Ray films position within the film holder fixture for reference by the user.

It is further contemplated that the holder fixture means be fabricated of a substantially solvent resistent plastic or metal material.

DETAILED DESCRIPTION OF THE DRAWINGS

Figure 1:
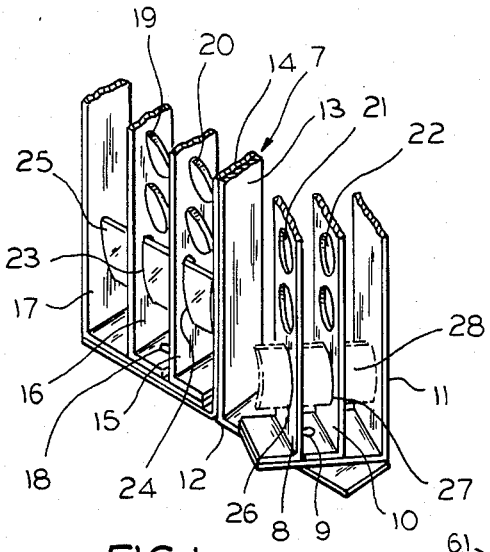
FIG. 1 (PRIOR ART)
FIG. 1 of the drawings is a side perspective view of one type of prior art film holder apparatus in which X-Ray films are positioned into film maintenance apertures and blocked by centrally and side positioned securement bars requiring pivotal rotation of the film maintenance members for insertion and removal of the X-Ray film.

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

Figure 2:
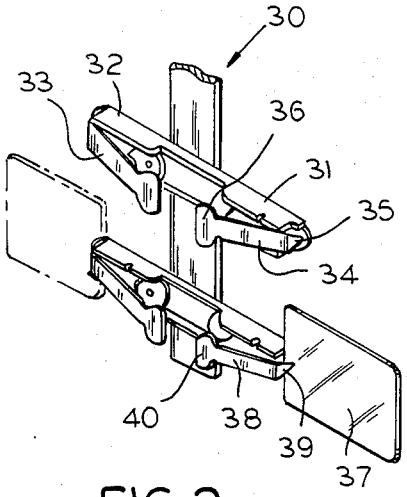
FIG. 2 (PRIOR ART)
FIG. 2 is a top perspective view of a portion of a second type of prior art X-Ray film holding apparatus which relies upon alligator type clipping means to maintain X-Ray films in position.

FIGS. 1 and 2 of the drawings set forth the structural details of two particular prior art film holder apparata from which Applicant's present invention is clearly distinguishable. FIG. 1 particularly shows utilization of prior art film holder apparatus 7 having a series of parallel film aperture bars such as bars 8 and 10, having apertures 21, 22, 26 and 27 therewithin, for the positioning and maintenance of X-Ray films such as X-Ray film 28. This particular device requires center bars such as bars 13 and 14 as well as side bars 11 and 17 to maintain the film in place within the device in an environment where aperture bars 8 and 10 and side bar 11 are integrally pivotable along pivot 9 to permit access into the apertures, and in which the integrated aperture and side bar structures are pivoted to position the left most edge of X-Ray film tray 28 in a position juxtaposed to side bar 13, so as to preclude inadvertent removal therefrom. The integrated bar assembly 8, 10, 11 is latched through locking means (not shown) to preclude the inadvertent pivoting of the aperture and side bar structure during the developing process. The bar structures are shown in their latched position on the leftmost side of FIG. 1 wherein apertures bars 15 and 16 and side bar 17 are locked into position so as to juxtapose the right most edge of X-Ray film 25 proximate to center bar 14.

In another commonly used prior art film holder apparatus, that of apparatus 30 of FIG. 2, alligator clips, such as clip 32-33 and 31-34, are utilized to literally "clip" each separate X-Ray film into position along the plurality of aligned clips. Each of the alligator clips, such as clip 31-34, possesses a holding point, such as holding point 35, which is capable of spring biased contact with the outermost surface of clipping element 31 so as to physically "notch" each positioned film at the point through which the spring biased pressure is being exerted between. Through such a construction, X-Ray film, such as film 37, can be maintained in position within spring loaded clip 38 and particularly between point 39 and the back portion of clip 38.

Figure 3:
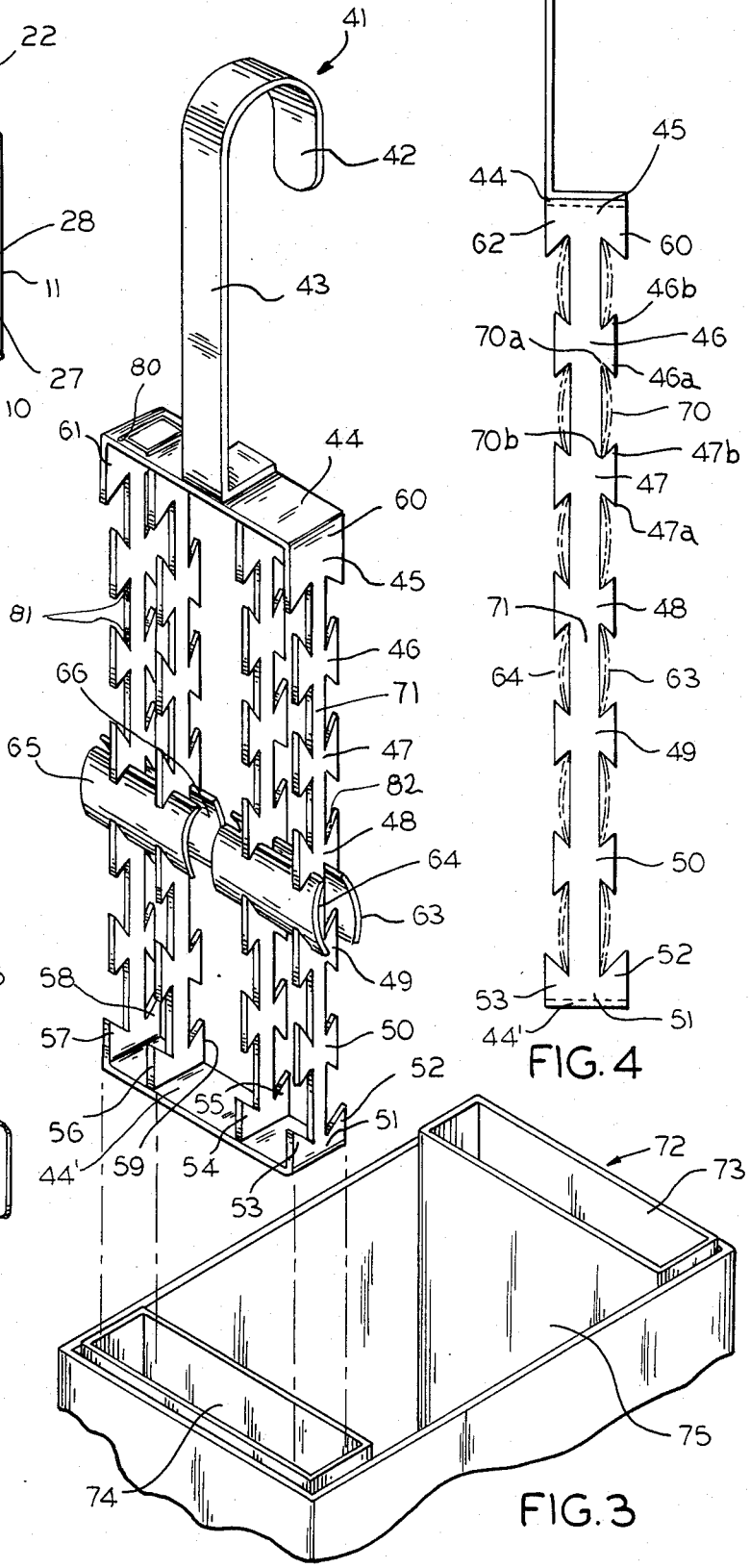
FIG. 3 is a top perspective exploded view of Applicant's film holder apparatus particularly showing the structural notched regions for insertion and removal of bowed X-Ray film together with a portion of a conventional developing tank and trays for use therewith.

Applicant's present film holder apparatus 41 is shown in FIG. 3 as including apparatus handle means 43, upper end 44, and lower end 44' as well as a series of longitudinally extended film holder members such as film holder members 71. Each of the film holder members are aligned and possess an alternating flange-recess structure as exemplified by film holder member 71 having flanges 46 through 51 with recesses interposed therebetween. Each of the flanges and recesses are substantially trapezoidal in shape so as to describe notched regions such as notched region 82 into which the opposite parallel ends of particular X-Ray films may be inserted. X-Ray films 63, 64, 65 and 66 are shown in their bowed-biased positions within their respective notched regions while at the same time showing the particular construction of Applicant's preferred embodiment in which a pair of aligned film holder members (having aligned flanges and recesses) serve to maintain each individual X-Ray film in position within the film holder apparatus. In the preferred embodiment of the invention, two aligned pairs of film holder members are encompassed within the overall film holder apparatus, with both sides of each film holder being capable of maintaining individual X-Ray films in position within the device.

As exemplified in FIG. 3, film holder apparatus 41, through its two columns of aligned film holders having flanges and recesses over the entire surface thereof, is capable of maintaining a total of twenty-four X-Ray films in position through placement of such structure along both the front and back sides of film holder apparatus.

Also shown in FIG. 3 are abrasion means 81 within respective notched regions to preclude undesirable and inadvertent migration of the film from within its position in the notched regions. These abrasion means preferably comprise a roughened or jagged surface portion to increase the coefficient of friction between the opposite edges of the X-Ray film and that portion of the notched region that these film edges contact. The height of lower end 44' of the invention includes substantially extended regions 53, 54, 56, 57, 58, 59, 55 and 52 for the purpose of elevating and removing the outermost bowed portion of the positioned film from contact with, for example, supporting table surface. Alternatively, flanges, such as flanges 45 through 50, may be of such a height to preclude such inadvertent contact (as further shown in FIG. 4). Such a configuration would include the intentionally correspondingly exaggerated heights of the upper end 44 with portions 60 and 61, preferably to the same height as 52 and 57, respectively. Through such a flange-recess construction, wherein trapezoidal shapes are positioned along the longitudinal holder members, the upper and lower edges of the maintained X-Ray films, such as films 64 and 65, substantially face the positions of the upper and lower ends 44 and 44' respectively, so as to minimize turbulence during the reciprocating and "swishing" operation in which the entire apparatus may be reciprocated within developing tray element 74 to satisfactorily and appropriately distribute developing and/or fixing solution over the surfaces of the positioned X-Ray films. Indicia placement means 80 is provided for the purpose of enabling the insertion of identifying indicia which relates information relative to the X-Ray films, (such as the patient for such films) to the user of the apparatus.

Figure 4:
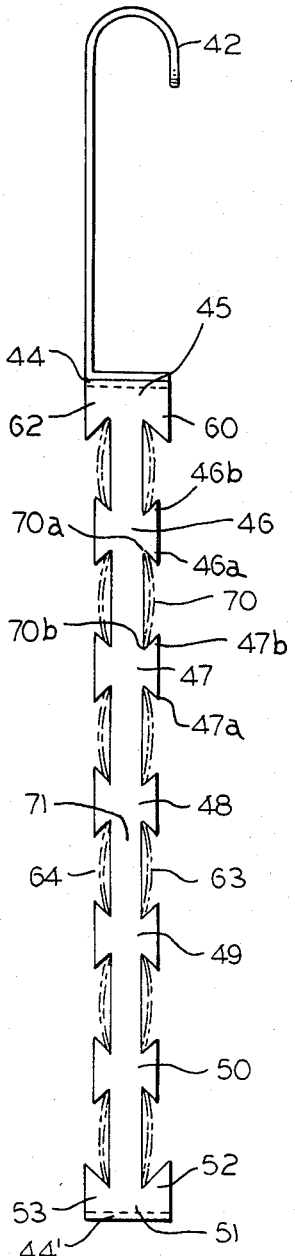
FIG. 4 is an elevational side view of the film holder apparatus of FIG. 3 showing, particularly, formation of the notched regions as well as the extended heights of the flange and/or top and bottom ends to preclude contact between the bowed X-Ray film maintained therewithin and a supporting surface on which the holder apparatus may be laid.

Handle means 42 together with upper and lower ends 44 and 44', respectively, are shown in FIG. 4 together with flanges 46 through 50 in an environment where each of the notched regions described by the successive notches and recesses are filled by X-Ray films. As can be seen, trapezoidal corners **46*a* and 46*b* on flange 46 serve to form the respective notched regions adjacent flange 46 in the same manner that flange edges 47*b* and 47*a* form the notched regions adjacent flange 47**.

The foregoing description and drawings merely explain and illustrate the invention and the invention is not limited thereto except insofar as the amended claims are so limited, as those skilled in the art who have the disclosure before them will be able to make modifications and variations therein without departing from the scope of the invention.

What is claimed is:

1. An improved X-Ray film holder apparatus for restrainably maintaining a plurality of substantially bowed X-Ray films in position within conventional developing tank insert trays, said apparatus comprising:

substantially flat holder fixture means having upper and lower end members as well as a plurality of film holder members operably disposed between said top and bottom end members in a direction substantially parallel to the longitudinal axis of said holder fixture means;

two or more of said film holder members comprising an alternating series of substantially trapezoid-shaped flange portions and substantially trapezoid-shaped recess portions so as to describe plurality of notched regions into which the opposite peripheral edges of a substantially bowed X-Ray film may be restrainably positioned;

each one of said two or more film holder members having said alternating series of flange portions and recess portions being in overall substantial alignment, with said flange and recess portions in a first of said two or more film holder members being in operable respective alignment with corresponding flange and recess portions in a second of said two or more film holder members, said first and second aligned film holder members collectively describing aligned ones of said notched regions for each of said bowed X-Ray films positionable therewithin so as to describe at least two notched regions into which each of said opposite peripheral edges of said bowed film comes into restrainable contact;

fixture position maintenance means operably attached along one of said upper and lower ends for facilitating the loading, maintenance and unloading of said film holder apparatus in and from said conventional developing tank insert tray;

means for precluding the undesired and inadvertent contact of articles with said bowed films restrainably positioned within said film holder apparatus, said holder fixture means being of such a thickness and height with said bowed films restrainably positioned therewithin so as to be closely and telescopically received by one or more of said developing tank's insert trays.

2. The X-Ray film holder apparatus according to claim 1 in which one or more of said notched regions includes abrasion means at the position where said notched regions contact the opposite peripheral edges of said bowed X-Ray film to further preclude the inadvertent and undesirable migration of said film during the developing process, said abrasion means comprising a jagged surface portion therewithin said notched region.

3. The invention according to claim 1 in which said holder fixture means includes two pairs of aligned film holder members so as to accommodate two separate columns of restrainably positioned bowed X-Ray films therewithin.

4. The invention according to claim 3 in which said holder fixture means includes twelve rows of notched regions along said film holder members, each pair of adjacent notched region rows capable of holding the opposite peripheral edges of one of said bowed X-Ray films so as to restrainably maintain six rows of bowed X-Ray films;

said rows and columns described by said film holder members capable of maintaining twelve films on one side of said film holder apparatus.

5. The invention according to claim 4 in which said flange portions and recess portions are positioned along both sides of each of said film holder members so as to describe, collectively, twenty-four rows of notched regions and four separate columns of aligned film holder member pairs, said double sided rows and columns described by said film holder members capable of maintaining twenty-four films along both sides of said film holder apparatus.

6. The invention according to claim 1 in which said fixture position maintenance means comprises a handle member operably positioned along said upper end of said holder fixture for co-operation with the upright edge of said developing tank insert tray so as to maintain, as desired, the overall position of said film holder apparatus during the X-Ray film developing process.

7. The invention according to claim 1 in which said X-Ray film holder apparatus may be easily reciprocated within said developing tank insert tray to effectively circulate solutions contained within said tray over all said positioned films, said upper and lower peripheral edges of said films respectively and substantially facing said upper and lower ends of said holder fixture means so as to reduce the turbulence created by said reciprocation to preclude splashing, fluid resistence within said tray as well as to preclude the inadvertent release of any one of said X-Ray films therewithin said tray from said film holder apparatus.

8. The invention according to claim 1 in which said means for precluding article contact comprises the height of one or more of said trapezoid-shaped flanges extending beyond the outermost bowed position of said X-Ray films to preclude contact of said bowed films by articles upon which said holder apparatus is flatly placed.

9. The invention according to claim 1 in which said means for precluding article contact comprises the height of one or more of said upper and lower ends of said holder fixture extending beyond the outer-most bowed position of said X-Ray films to preclude contact of said bowed films by articles upon which said holder apparatus is flatly placed.

10. The film holder apparatus according to claim 1 in which the invention further comprises indicia placement means for maintaining identifying indicia relating to said restrainably positioned X-Ray films.

11. The invention according to claim 1 in which said holder fixture means is fabricated of a substantially solvent resistent plastic material.

12. The invention according to claim 1 in which said holder fixture means is fabricated of a substantially solvent resistent metal material.

* * * * *